US005566956A

United States Patent [19]

Wang

[11] Patent Number: 5,566,956

[45] Date of Patent: Oct. 22, 1996

[54] IN-LINE SKATEBOARD

[76] Inventor: Di Wang, 1 Lake Ridge Pl., Apt. C, Cockeysville, Md. 21030

[21] Appl. No.: 453,807

[22] Filed: May 30, 1995

[51] Int. Cl.[6] ..... A63C 17/06; A63C 17/28

[52] U.S. Cl. ..... 280/7.14; 280/842; 280/11.22; 280/87.041; 280/87.042

[58] Field of Search ..... 280/7.12, 7.13, 280/7.14, 841, 842, 11.19,11.2,11.22, 11.23, 87.01, 87.041, 87.042, 826, 14.2

[56] References Cited

U.S. PATENT DOCUMENTS

| | | | |
|---|---|---|---|
| 887,812 | 5/1908 | Johnson | 280/87.042 |
| 2,148,687 | 2/1939 | English | 280/7.13 |
| 3,574,969 | 4/1971 | Cleveland | 280/87.041 |
| 3,995,873 | 12/1976 | Pantzar | 280/87.04 A |
| 4,145,064 | 3/1979 | Carn | 280/87.01 |
| 4,234,204 | 11/1980 | Tibbals | 280/87.042 |
| 4,235,448 | 11/1980 | Thomas | 280/11.1 BT |
| 4,382,605 | 5/1983 | Hegna | 280/7.13 |
| 4,896,893 | 1/1990 | Shumays et al. | 280/7.14 |
| 5,048,851 | 9/1991 | Alarcon | 280/87.042 |
| 5,125,687 | 6/1992 | Hwang | 280/842 |
| 5,160,155 | 11/1992 | Barachet | 280/87.042 |
| 5,372,384 | 12/1994 | Smith | 280/842 |
| 5,419,570 | 5/1995 | Bollotte | 280/87.042 |

*Primary Examiner*—Anne Marie Boehler
*Attorney, Agent, or Firm*—James L. Bean

[57] ABSTRACT

An in-line skateboard for supporting a rider with his feet in side-by-side relation one on each side of the longitudinal centerline of the board has a toe abutment wall for preventing forward movement of the rider's shoes and a heel support supporting the shoe heels at an elevation substantially above the surface of the board. The wheel base is very short, preferably no greater than the distance between the toe abutment and the heel support, to provide steering control by the rider by leaning the skateboard and shifting his weight to provide more or less weight on the front or rear wheels, respectively. The in-line wheels may be replaced with a single skate blade for using the skateboard on ice.

11 Claims, 4 Drawing Sheets

IN-LINE SKATEBOARD

BACKGROUND OF THE INVENTION

1. Field of the Invention

This invention relates to skateboards and more particularly to an improved skateboard having means for contacting a support surface only along the longitudinal centerline of the board.

2. Description of the Prior Art

The term "skateboard" is generally used to refer to a sporting device including an upper, generally horizontal, elongated board for supporting a rider standing on its top surface, and four wheels mounted in pairs on trucks or transverse axles mounted on its bottom surface for limited pivotal steering movement adjacent the front and rear ends, respectively, of the board. The rider stands on the board with his feet extending generally transversely of and spaced apart along its longitudinal axis, and the board is steered by the rider selectively shifting weight to apply more pressure to the wheels on one side or the other of the board. The wheel mounting and steering operation of such prior art skateboards is described, for example, in U.S. Pat. No. 5,160,155.

Skateboards are also known which have only two wheels mounted on the longitudinal centerline of the board one adjacent each end thereof, and one such skateboard is disclosed in the above-mentioned U.S. Pat. No. 5,160,155. In this prior art device, the front wheel is supported by a fork arrangement rotatable about an upwardly extending pivot axis with the wheel contacting the ground rearwardly of the point of intersection of the pivot axis with the ground so as to provide automatic steering on tilting of the board. The rear wheel is mounted for rotation about a fixed axis close to, but rearwardly of the board centerline, with the fixed axis being in the plane of the board so that the upper portion of the wheel projects above the board surface. In use of this skateboard, the rider stands with one foot forward and one foot rearward of the rear wheel, again with both feet extending generally transversely of the board for balance, control and steering.

U.S. Pat. No. 3,995,873 also discloses a skateboard having only two wheels located one near each end and on the longitudinal centerline of the board. In this device, the wheels or rolls have an axial length at least equal to half the width of the board to provide transverse stability for the board. The rolls are mounted and arranged to steer in opposite directions upon tilting of the board. In use, the rider stands on and steers the device in the same manner as conventional four wheel skateboards.

U.S. Pat. No. 5,125,687 discloses a roller board intended to simulate skiing over a road surface. In use of this board, the rider stands with his feet in side-by-side relation extending lengthwise of the board which is supported by a pair of rollers or wheels positioned on its longitudinal axis, one forward of and one near the rear of the rider support surface of the board. A pair of outrigger rollers are mounted one adjacent each lateral edge of the board to limit the tilting movement about the longitudinal roll axis as defined by the main support wheels. Two footholds are provided on the board's top surface, with a raised divider separating the footholds along the longitudinal centerline of the board to accurately position the rider's feet on the board's surface. The front wheel is supported by a caster or fork for steering, with a spring normally biasing the fork to its centered or straight line position. This patent also discloses use of a removable skate blade which may be mounted on the bottom of the board, to adapt the device for use on ice, and suggests the use of a saddle mounted on the board's top surface to allow the rider to sit while maintaining his feet on the generally horizontal surface of the footholds. The rider propels himself by use of a pair of handheld poles.

In the prior art skateboards and rollerboards described above, the stability of the boards carrying a standing rider, particularly during extreme maneuvering, has required a relatively long wheel base which, in turn, has generally required caster mounting or steerable truck mounting of the wheels, or at least the front wheel or wheels for maneuvering.

SUMMARY OF THE INVENTION

In accordance with the present invention, a skateboard is provided which does not require pivotal or steering mounting of the wheels and which is particularly adapted to be used by a rider in the squatting position with his feet side by side and facing in the direction of movement over a road or other support surface. A primary object of the invention is to provide a skateboard employing fixed axle wheels which are mounted in-line along the centerline of the device.

Another object is to provide such a skateboard in which the wheel base, or spacing between the axes of rotation of the front and rear support wheels, is sufficiently short to enable maneuvering by a rider without requiring pivotal or castered mounting of any support wheel.

Another object of the invention is to provide such a skateboard having a fixed front abutment for engaging the toes of shoes worn by the rider to prevent relative movement between the shoes and skateboard during use, and having heel support means providing vertical support for the user's heels at an elevation substantially above the toe abutment.

Another object is to provide such a skateboard in which the wheel base is very short and preferably substantially equal to or less than the length of the rider support, as measured on an incline from the toe abutment to the back of the elevated heel support.

Another object is to provide such a skateboard having removable seat means for supporting a portion of the rider's weight during use.

Another object is to provide such a skateboard in which the support wheels may be removed and replaced with a single skate blade for use of the device on ice.

Another object is to provide such a skateboard in which the user may propel himself while in the squatting position with both feet on the board, using handheld poles or other devices having friction means for engaging the ground or ice surface.

BRIEF DESCRIPTION OF THE DRAWINGS

Other objects and advantages of the invention will be apparent from the description contained herein, taken in conjunction with the drawings, in which.

DESCRIPTION OF THE PREFERRED EMBODIMENTS

Figure 1:
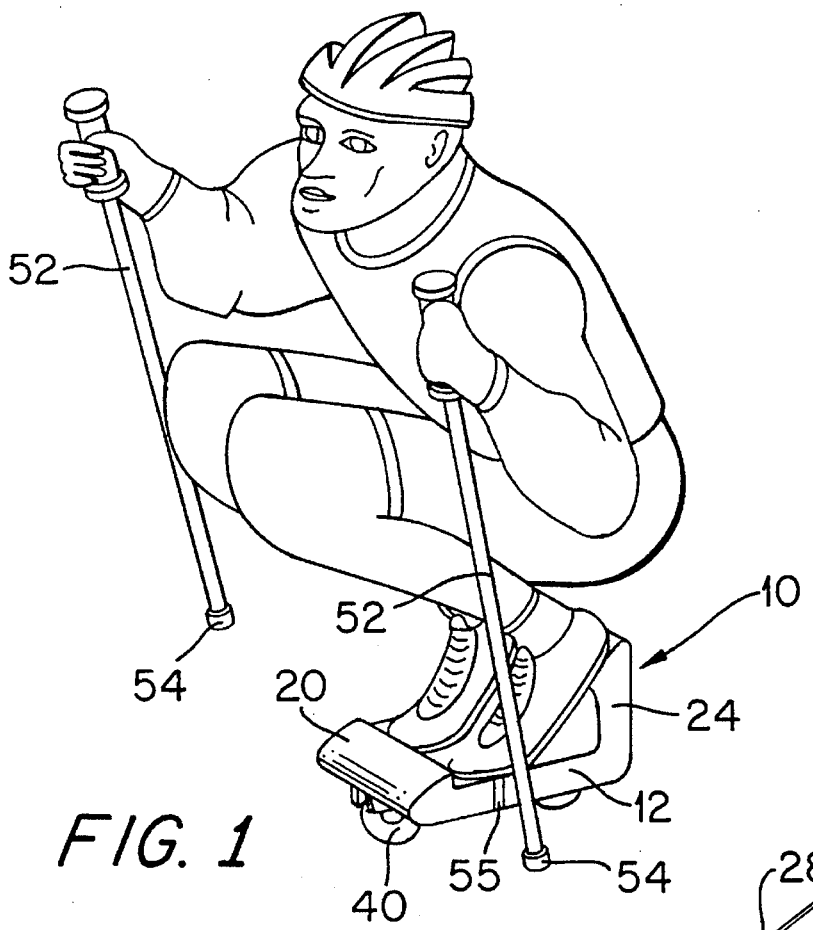
FIG. 1 is a perspective view showing a rider using the improved skateboard according to the present invention.

Referring now to the drawings in detail, a skateboard embodying the present invention is indicated generally by the reference numeral 10 and is shown in FIG. 1 with a rider thereon in the position of normal use of the skateboard. Thus, contrary to the manner of use of the normal skateboard wherein the rider stands with his feet generally transverse to the direction of movement, the skateboard 10 of the present invention is intended to be used with the feet side-by-side in the fore and aft direction of movement, one on each side of the longitudinal centerline of the skateboard and with the rider in the squatting position so that the center of gravity of the rider and board is relatively close to the supporting surface, or ground.

Referring now to FIGS. 2–6, it is seen that the board assembly includes a generally horizontal body, or board 12 having a raised toe abutment 14 extending across its top surface at the forward end portion. The toe abutment 14 has a substantially vertical, rearwardly facing wall 16, with wall 16 having a height sufficient to engage the forward toe portion of the rider's shoes to firmly and reliably retain the shoes from forward movement during use of the assembly. Preferably this height is within the range of about ¾ to 1⅛ inches (2 to 3 centimeters). The wall 16 may extend in a substantially straight transverse line as shown in solid lines in FIG. 3, or be contoured to act as a guide in positioning the feet on the board for improved balance.

The forward end portion 18 of board 12 preferably is rounded, or contoured, for a more pleasant appearance and the top surface 20 of toe abutment 14 may be contoured and blended into the contoured end surface 18. Further, the toe abutment 14 and board 12 may be molded as a unitary structure from a suitable material such as a high strength or reinforced synthetic resin material, or the toe abutment may be separately formed and joined to the top surface of the board as by bonding and/or threaded fasteners (not shown) extending through the board 12 into the toe abutment structure.

A heel support platform 22 projects upwardly from the top surface of board 12 at its rear end. Platform 22 includes a web portion 24 extending transversely of board 12 and projecting upwardly therefrom to terminate at its top edge in a heel support flange 26 having a forwardly and downwardly inclined top surface 28 for engaging and supporting the shoe heels of a rider using the skateboard. If desired, surface 28 may be roughened or have an abrasive or other high friction coating thereon. Web 24 preferably has an enlarged base or pedestal 30 joined to the top surface of board 12, and as with toe abutment 14, the heel platform may be integrally formed as a part of a molded assembly, or separately formed and joined thereto as by bonding and/or threaded fasteners extending upwardly through the board 12 into the body of the pedestal 30.

A frame 32 is mounted on the bottom surface of board 12 for releasably mounting a ground support means on the bottom of the board 12. Frame 32 includes a pair of laterally spaced, fore and aft extending side rails 34 integrally joined, at their top edge, to a mounting flange 36 adapted to be attached, as by removable fasteners 38, to the bottom of the board 12. Two wheels 40 are mounted between the rails 34 with their axes of rotation perpendicular to the vertical centerplane of the board. Wheels 40 may be conventional in-line roller blade wheels having smooth curved toroid ground engaging surfaces which are formed from a slightly resilient material as is conventional in roller blades. The wheels 40 are mounted by suitable bearings, not shown, supported upon removable axles 42 extending through openings in side rails 34. The axles 42 are spaced from one another to provide a short wheel base for the skateboard, with the axles having a spacing no greater than the distance between the toe abutment walls 16 and the back of the heel support platform. Preferably the front axle is located beneath or in back of wall 16 and the rear axle is located beneath or forward of web 24. This very short wheel base makes it possible for the rider to maneuver or steer the skateboard by shifting his weight to lean the board to one side or the other and to vary the load distribution between the front and rear wheels. This steering action may result in part from relative lateral sliding movement between the wheels as a result of the uneven weight distribution and in part from slight bending or distortion of the side rails 34, both due to the uneven weight distribution of the rider above the wheels while leaning the device toward the direction in which steering is desired.

A suitable braking device of the type conventionally employed in in-line rollerskates, indicated at 44, is provided on the back of frame 32 rearwardly of the back wheel, with brake means 44 including a resilient pad element 46 supported by brackets 48 supported on suitable bracket means mounted between the rails 34.

Figure 2:
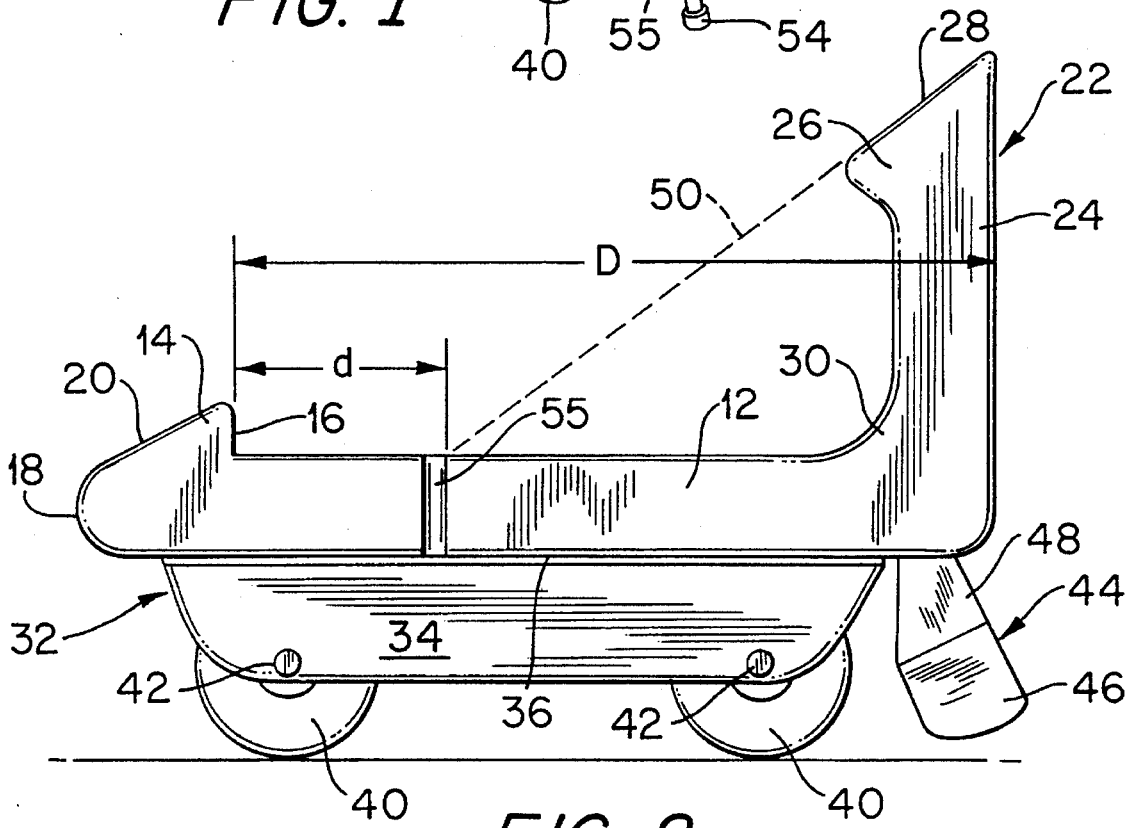
FIG. 2 is a side elevation view of a skateboard embodying the invention.

As best seen in FIGS. 1 and 2, a rider using the improved skateboard of the present invention places the toes of his shoes against the abutment wall 16 with the heels of the shoes resting on the inclined top surface 28 of flange 26. In this position, the shoes will bend and the forward portion of the shoe soles from approximately the balls of the feet to the toes of the shoes will rest flat on the top surface of board 12, while the remainder of the shoe sole will be inclined upwardly and rearwardly in spaced relation to the top surface of the board 12. The inclined surface 28 extends at an angle such that its extended plane indicated by the broken line 50 intersects the top surface of the board 12 at a distance d from wall 16 which preferably is at least about ¼ the distance D between the wall 16 and the back of the heel platform. The angle of this inclined plane may make an angle relative to the horizontal of about 25° to about 55°, preferably about 35° to about 45°. This arrangement enables the rider to comfortably assume a squatting position as illustrated in FIG. 1 with his weight distributed between the toe and heel portions of his feet and transferred to the front and rear wheels 38. In this squatting position, the rider can propel himself along a relatively smooth ground surface such as a roadway, sidewalk, or the like using a pair of poles 52 similar to conventional ski poles and having a resilient, high friction tip 54 similar to a crutch tip on the bottom end for engaging the ground surface. Other handheld, ground engaging devices may also be used to propel the rider and skateboard over the ground surface, and the tips 54 may be replaced by a sharpened point when the device is employed as an ice skate as described hereinbelow.

The short wheel base of the skateboard, and the location of the rear wheel axle beneath or preferably slightly forward of the heel support platform enables the rider to easily pivot the board about the rear wheel axle by shifting more of his weight to the heel support platform to thereby bring the brake pad into contact with the road surface to slow the device.

To steer to the left or to the right, it is only necessary for the rider to lean the board in the desired direction of turn and shift his weight slightly to place more of the weight on the ball of his feet at a location on the board closer the front axle to thereby relieve some of the load from the rear wheel. Inherent flexibility in the front wheel, axle support and wheel frame permit some slight turning and/or distortion of the front wheel while the reduced weight on the rear wheel permits limited relative lateral movement or slippage of the rear wheel, enabling reliable, controlled steering of the skateboard without the necessity of pivotal or caster mounting of the wheels as in the prior art skateboards described hereinabove.

To assist the novice rider in initially mounting the skateboard 10, a pair of notches 55 are provided one in each side edge of the body 12 at a location spaced rearwardly from toe abutment wall 16 a distance approximately one third the length of body 12. By placing the lower end portion of one of the poles 52 in one of the notches 55, with the tip 54 resting firmly on the ground surface, the skateboard is retained against movement forward or rearward during mounting. Also, by inclining the pole 12 outwardly so that the tip 54 extends beneath the board, some roll stability is achieved, and further roll stability may be achieved with the rider's hand on the side of the skateboard 10 opposite the side being engaged and stabilized by the pole 52. By providing a notch 55 on each side of the body 12, symmetry is achieved and the board is readily mounted by either a left handed or right handed rider.

Figure 7:
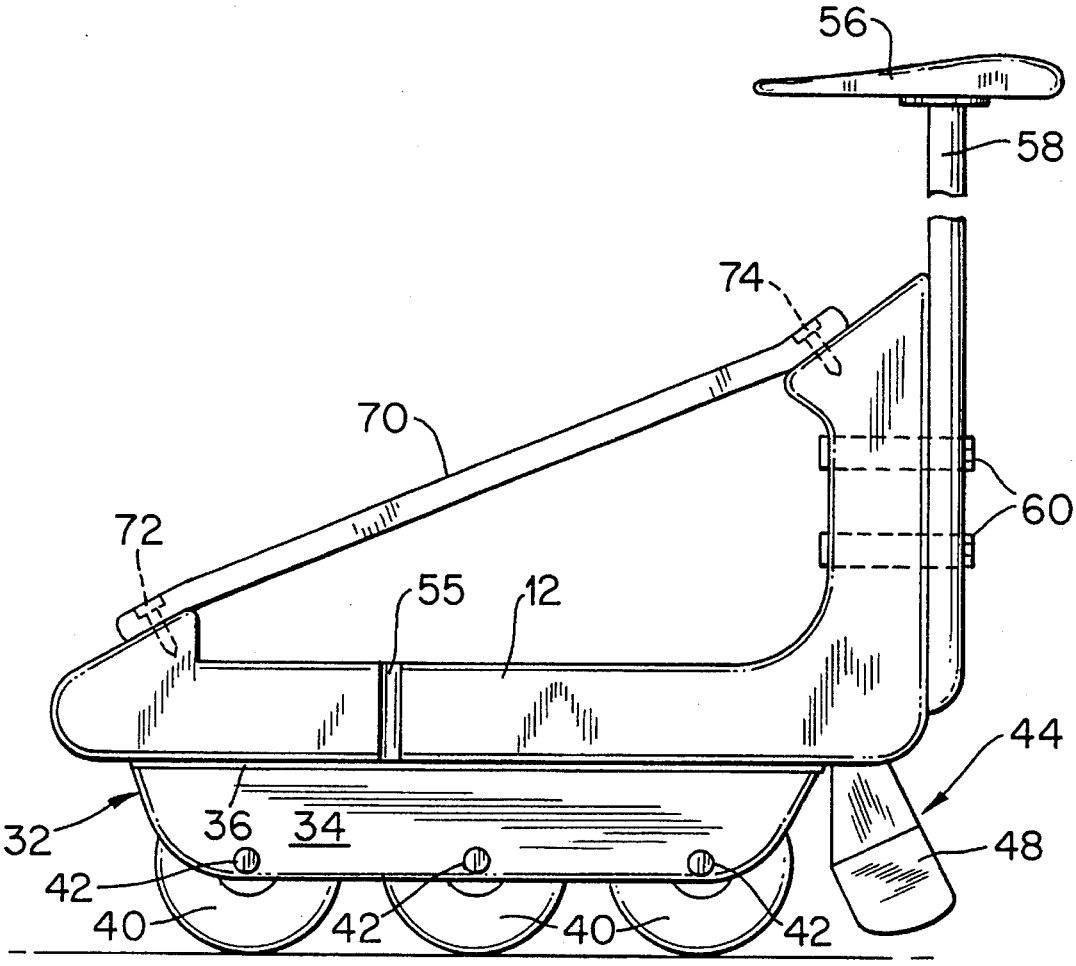
FIG. 7 is a view similar to FIG. 2 and showing an alternate embodiment of the invention.

Referring to FIG. 7, an alternate embodiment of the invention is illustrated in which a seat 56 rigidly mounted on an upwardly extending post member 58 is releasably mounted, as by threaded fasteners 60 on the rear side of the heel platform 22 on the longitudinal centerline of the skateboard. Post 58 has a height which positions the seat at a location which permits the rider to assume a position substantially as illustrated in FIG. 1, i.e., a squatting position, while resting a portion of his weight on the seat to avoid fatigue during long periods of riding. The seat is not intended to act as a full support for the rider, however, and at least a portion of the weight must be transferred to the board through the rider's feet in order to maintain balance and steering control. FIG. 7 also illustrates the use of a third wheel 40 located between the front and rear wheels.

Figure 8:
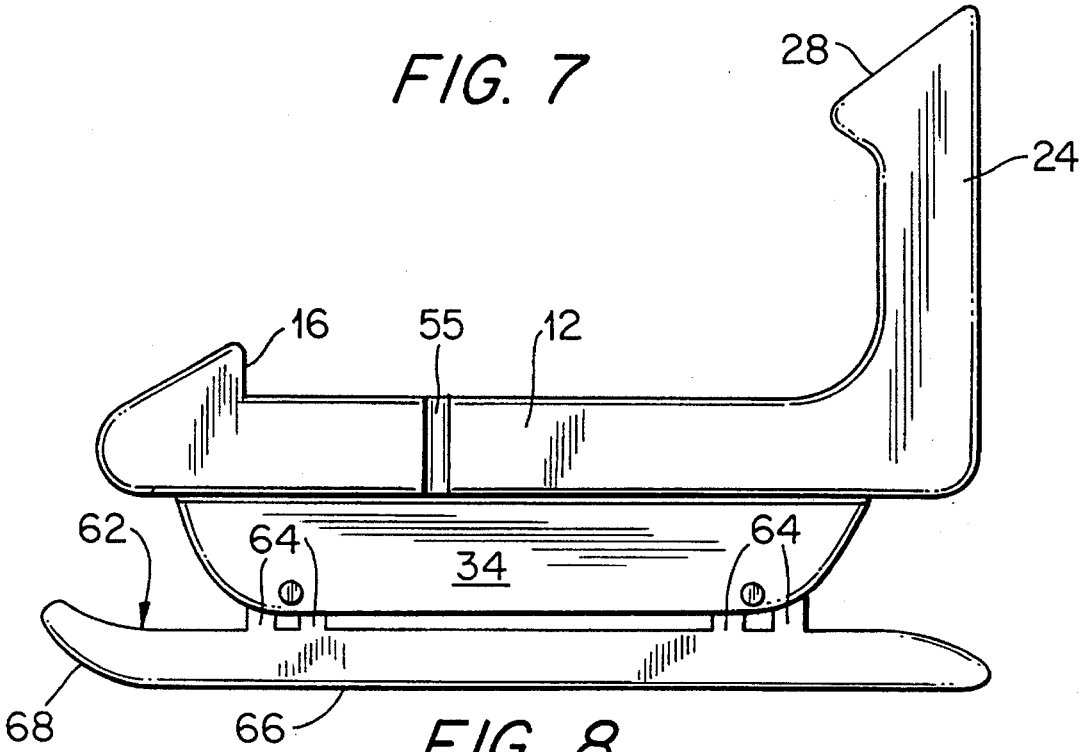
FIG. 8 is a view similar to FIG. 5 and showing a modification of the invention for use as an ice skateboard.

FIG. 8 illustrates a modification of the skateboard assembly in which the wheels 40 have been removed and replaced with a skate blade assembly including a single blade 62 having a straight runner portion 64 and an upwardly curved front end portion 66 substantially as is employed on conventional ice skates. The blade 62 is supported by upwardly extending posts 64 rigidly joined between the side rails 34, or by bolts, not shown.

In use, the skate version of FIG. 8 is employed in the same manner as described above with respect to the wheel embodiment. In this embodiment, however, the propelling poles 52 employed will normally have a sharpened tip for penetrating the ice surface to enable the user to propel himself over the ice.

In maneuvering the board on the skate blade, as the rider shifts his weight forward and tilts the board in the direction of the desired turn, the increased weight on the transition between the straight and upwardly curved portions of the blade provides steering, with the back portion of the blade, which carries a reduced portion of the rider's weight, slipping laterally sufficiently to follow through a smooth control turn.

Figure 3:
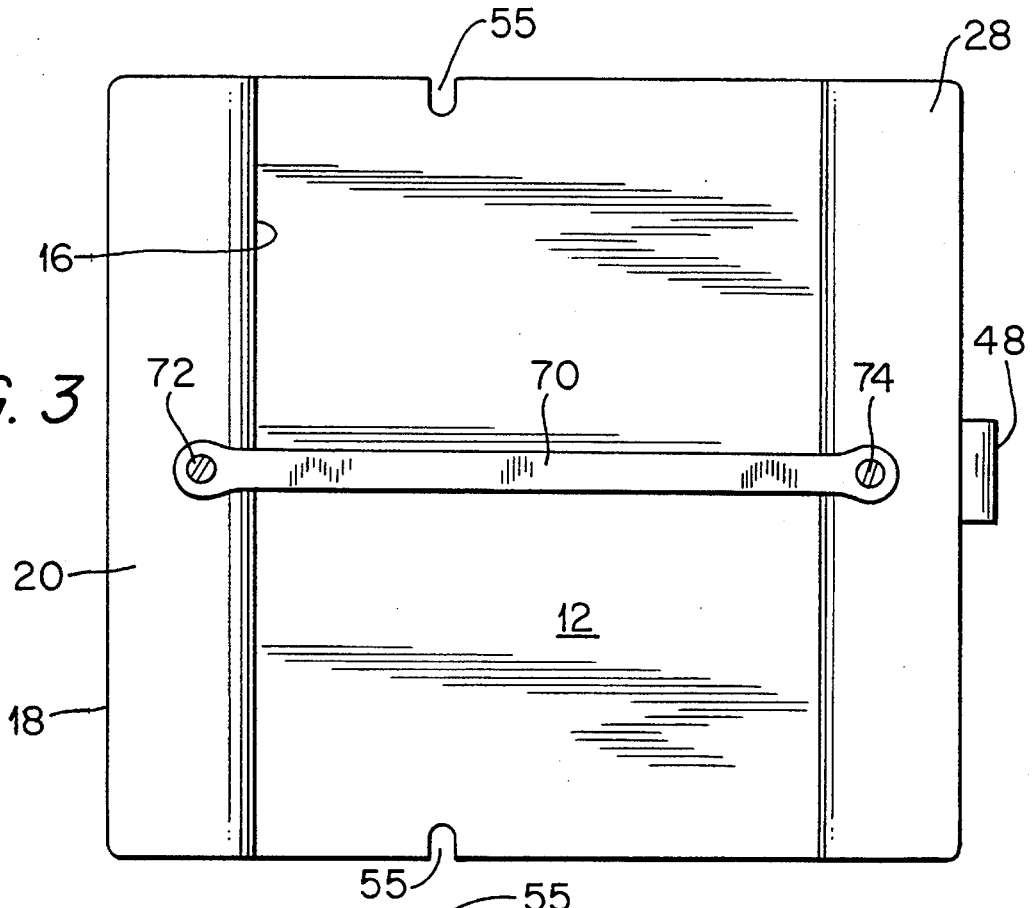
FIG. 3 is a top plan view of the skateboard shown in FIG. 2.
Figure 4:
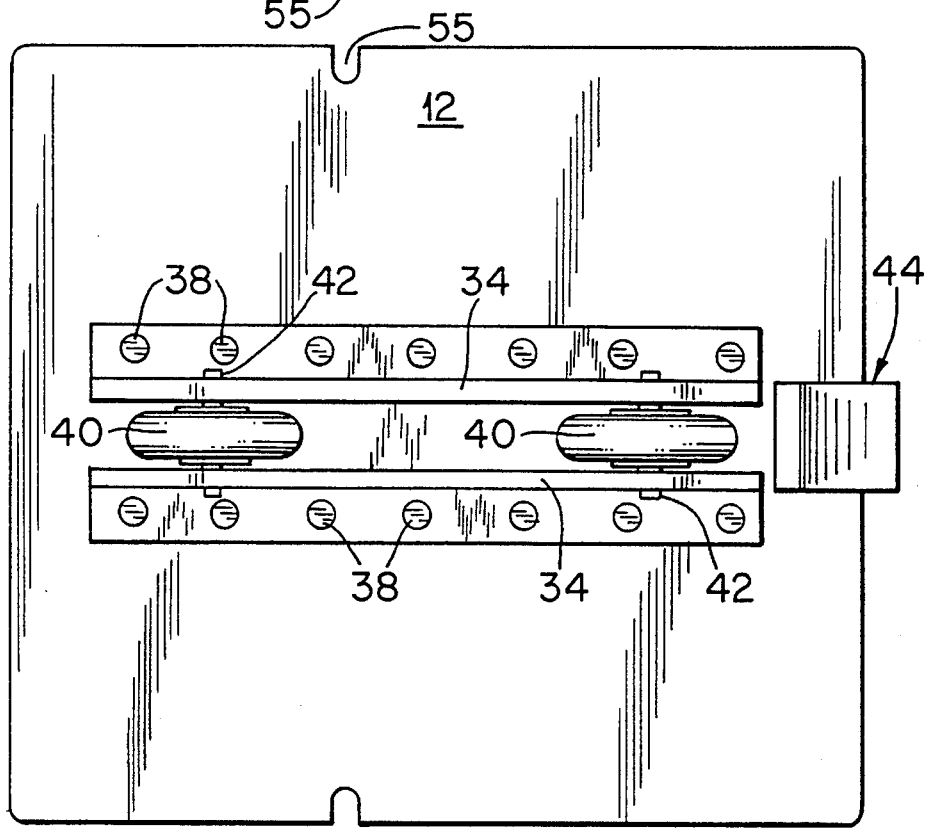
FIG. 4 is a bottom plan view of the structure shown in FIGS. 2 and 3.
Figure 5:
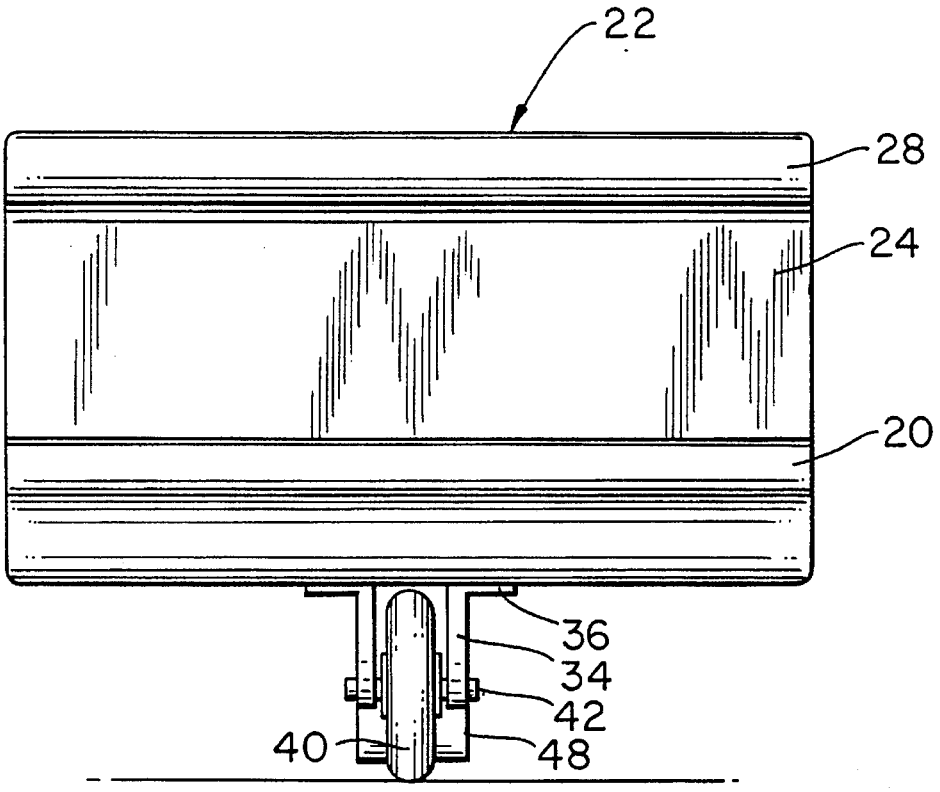
FIG. 5 is a front end elevation view of the skateboard shown in FIGS. 2–4.
Figure 6:
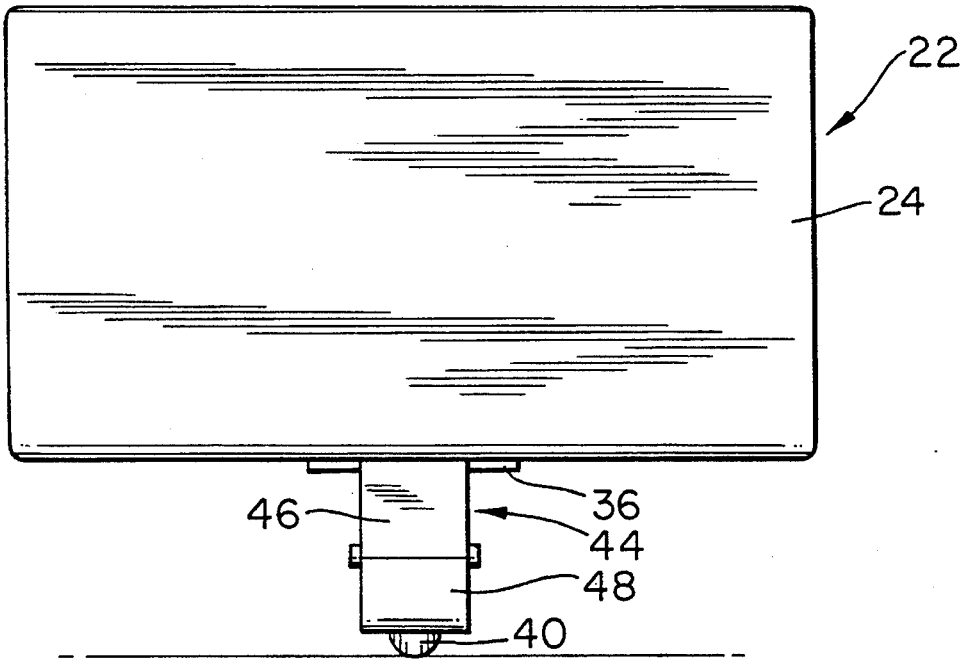
FIG. 6 is a rear end elevation view of the skateboard shown in FIGS. 2–5.

A further modification to the invention is shown in FIGS. 3 and 7 wherein a removable, longitudinally extending central divider bar, or jump bar 70 is mounted, as by screws 72, 74, to the top surfaces 20, 28, respectively. Divider bar 70 is dimensioned to enable a rider to firmly grasp the member between his feet to lift the skateboard for jumping.

While preferred embodiments of the invention have been disclosed and described, it should be understood that the invention is not so limited and that it is intended to include all embodiments which would be apparent to one skilled in the art and which come within the spirit and scope of the invention.

What is claimed:

1. A skateboard comprising a rider support board having top and bottom surfaces, a front end portion and a rear end portion, and a width sufficient to support the two feet of a rider in side-by-side relation on said top surface one on each side of the longitudinal centerline of the board, a support frame mounted on said bottom surface, a front wheel and a rear wheel mounted in in-line relationship on said support frame for rotation in the longitudinal vertical centerplane of the board, toe abutment means extending across said front end portion and projecting upwardly therefrom in position to engage the toe end portion of a rider's shoes to prevent forward movement of the rider's feet over said top surface of the board, and heel support means extending substantially across the full width of said rear end portion and projecting upwardly therefrom in position to engage and support the heel portion of a rider's shoes above said top surface when the rider's shoe toes are in abutting relation with said toe abutment means, said front wheel being mounted for rotation about an axle supported on said wheel support frame at a location rearwardly of said toe abutment means, and said rear wheel being mounted on an axle supported on said wheel support frame at a location forward of said heel support means.

2. The skateboard defined in claim 1 wherein said rider support board, said toe abutment means, and said heel support means are integrally molded from a single mass of synthetic resin material.

3. The skateboard defined in claim 1 wherein said heel support means has a height such that, when a rider is positioned on the skateboard with his shoe toes in engagement with said abutment means, the shoe soles adjacent the heel extends in a plane making an angle with said top surface of 25° to 55°.

4. The skateboard defined in claim 3 wherein said-heel support comprises a forwardly and downwardly inclined top heel support surface disposed in a plane intersecting said top surface of said board rearwardly of said toe abutment means.

5. The skateboard defined in claim 4 wherein the included angle between said plane of said heel support surface and said top surface of said board is between 25° and 55°.

6. The skateboard defined in claim 5 wherein the included angle between said plane of said heel support surface and said top surface of said board is between 35° and 45°.

7. The skateboard defined in claim 1 further comprising seat means mounted on and projecting upwardly from said heel supports whereby a portion of the rider's weight may be supported by the seat means with the remainder of the rider's weight supported by the feet on said top surface and heel support means.

8. The skateboard defined in claim 1 further comprising a resilient road-engaging brake pad, and means mounting said brake pad on said rider support board rearwardly of said rear wheel in position to engage the ground surface upon tilting movement of the skateboard about the axle of said rear wheel by the rider.

9. The skateboard as defined in claim 1 wherein said front wheel and said rear wheel are removably mounted on said support frame, and further comprising a single ice skate blade adapted to be removably mounted on said support frame when said front wheel and said rear wheel are removed.

10. The skateboard as defined in claim 1 further comprising a recessed notch formed in at least one side edge of the rider support board for receiving an elongated member held by the rider and having one end engaging the ground surface to stabilize the skateboard during mounting by the rider.

11. The skateboard as defined in claim 1 further comprising a longitudinally extending central divider means between said toe abutment means and said heel support means and extending upwardly above said top surface in position to be gripped between the feet of a rider to enable jumping with the skateboard.

* * * * *